United States Patent [19]

Nowak

[11] Patent Number: 4,542,040

[45] Date of Patent: Sep. 17, 1985

[54] METHOD AND MEANS FOR SPRAYING AGGREGATES FOR FIREPROOF INSULATION ONTO A SUBSTRATUM

[76] Inventor: David M. Nowak, 1427 Hampshire Dr., South Bend, Ind. 46614

[21] Appl. No.: 604,369

[22] Filed: Apr. 26, 1984

Related U.S. Application Data

[63] Continuation of Ser. No. 449,468, Dec. 13, 1982, abandoned.

[51] Int. Cl.[4] ..... B05D 1/12

[52] U.S. Cl. ..... 427/196; 427/426; 118/308

[58] Field of Search ..... 427/196, 426; 118/308; 239/306, 418, 422, 423

[56] References Cited

U.S. PATENT DOCUMENTS

| | | | |
|---|---|---|---|
| 1,881,345 | 10/1932 | Beatty et al. | 427/426 |
| 2,433,463 | 12/1947 | Lampe | 427/196 |
| 3,606,154 | 9/1971 | Tufts | 239/8 |
| 3,676,197 | 7/1972 | Harrison et al. | 427/196 |
| 4,109,032 | 8/1978 | Barrall | 427/255 |
| 4,159,302 | 6/1979 | Greve et al. | 264/333 |
| 4,160,491 | 7/1979 | Matsumoto | 106/90 |
| 4,317,851 | 3/1982 | Neser | 427/426 |

FOREIGN PATENT DOCUMENTS

| | | | |
|---|---|---|---|
| 1249157 | 10/1971 | United Kingdom | 427/196 |

*Primary Examiner*—Shrive P. Beck
*Attorney, Agent, or Firm*—James D. Hall

[57] ABSTRACT

A method of making an insulation product to be used as a thermal resistor and fire retarder, and also to an apparatus for the accomplishment of this process. This method involves the pressurized spraying of expanded particles and an adhesive towards a target surface in a manner whereby the adhesive contacts the particles prior to their hitting a target surface. The apparatus involves a spraying device which directs the expanded particles and the adhesive into the intersecting paths necessary to facilitate adhesive-particle contact prior to their hitting the target surface, and serves to minimize loss of the aggregate due to bounce-back of the aggregate from the target surface.

1 Claim, 6 Drawing Figures

METHOD AND MEANS FOR SPRAYING AGGREGATES FOR FIREPROOF INSULATION ONTO A SUBSTRATUM

This application is a continuation of application Ser. No. 449,468, filed Dec. 13, 1982 now abandoned.

FIELD OF THE INVENTION

This invention relates to a method of making an insulation product for use as a thermal resistor and fire retarder and to an apparatus for carrying out this method.

BACKGROUND OF THE INVENTION

Expanded perlite and vermiculite particles have gained widespread popularity throughout the insulation industry. They exhibit a relatively good thermal resistance and are excellent fire retarders. Using the method of this invention, a higher thermal resistance than possessed by untreated perlite is achieved. It should be noted that untreated perlite has a thermal conductivity or "R" of 2.7 per inch. Using the unique method of this invention, the thermal resistance of a perlite containing insulation product is substantially increased in value.

Attempts have been made in the past to affix perlite and other particles to a substratum. One technique used was to premix the perlite and a binder and force the material through a plater type of machine and then through a spray gun. This method allows the mixture to harden prematurely, causes some particles to crush and lose particle size effectiveness, causes damage to the machine and has a very high loss ratio. Thus, up to 50% of the material has been wasted during application to a substratum in prior methods. Several other drawbacks were present in prior attempts to spray perlite upon a substratum. The amount of perlite and adhesive initially applied to a substratum and adhering thereto was often quite small. The application of the perlite aggregate and binder at a high velocity caused a high loss ratio of the applied material. The machines discharging the aggregate were designed for distribution of fibrous materials, and as the expanded aggregate was introduced within the machine, the machine has a tendency to crush a substantial portion of the particles. Perlite is a silicate and crushing of substantial portions of the perlite causes machine parts to "freeze" or adhere together due to silification, significantly shortening machine life.

Through extensive experimentation with prior art thermal insulation materials, machines, and spray nozzles, I have devised a new method of, and apparatus for, aggregate application to obtain the goals described herein.

SUMMARY OF THE INVENTION

The method and apparatus of this invention serve to significantly reduce the problem of loss of the expanded perlite aggregate as it is sprayed upon a substratum. By this method, expanded perlite particles and an adhesive are separately discharged in intersecting paths toward a substratum by a spraying apparatus. The adhesive first contacts the particles at a point spaced from the spray apparatus and from the surface of the substratum. Sprayed in this manner, the adhesive first contacts and coats the particles in air and then causes them to bond to the substratum. Because of the short time span between particle-adhesive contact, and contact with the substratum, the aggregate coating does not have an opportunity to cure to any significant extent before the coated particles strike the substratum, so loss due to bounce-back from the substratum is very low.

The design and construction of the spray nozzles for the adhesive and the means discharging the particles minimizes the crushing of particles. This new method prevents the surface of the substratum from becoming overburdened with adhesive which may cause the particles to slide off the sprayed surface due to the weight of adhesive and particles. Thus, the method prevents a pulling or sloughing effect, as frequently occurs in the use of prior methods.

An apparatus is disclosed which best carries out the method of this invention. The apparatus provides separate discharge of the particles and the adhesive directed in intersecting paths. By controlling the respective discharge forces and speeds of the particles and the adhesive, the particles can be caused to decelerate as they leave the apparatus, to facilitate mid-air contact thereof by the adhesive.

Accordingly, it is an object of this invention to provide a novel method and apparatus for coating a substratum or for filling a panel mold with insulation material.

Another object is to provide a method and apparatus for coating a substratum or filling a mold with insulation material with minimum loss of the aggregate.

Another object is to provide a method and apparatus for coating a substratum or filling a mold which is efficient and economical.

Still another object is to provide a method and apparatus for coating a substratum or filling a mold which accurately controls the flow of the constituent materials.

Other objects will become apparent upon a reading of the following description.

BRIEF DESCRIPTION OF THE DRAWINGS

A preferred embodiment has been chosen to best explain the principles of the invention wherein.

DESCRIPTION OF THE PREFERRED EMBODIMENT

Figure 1:
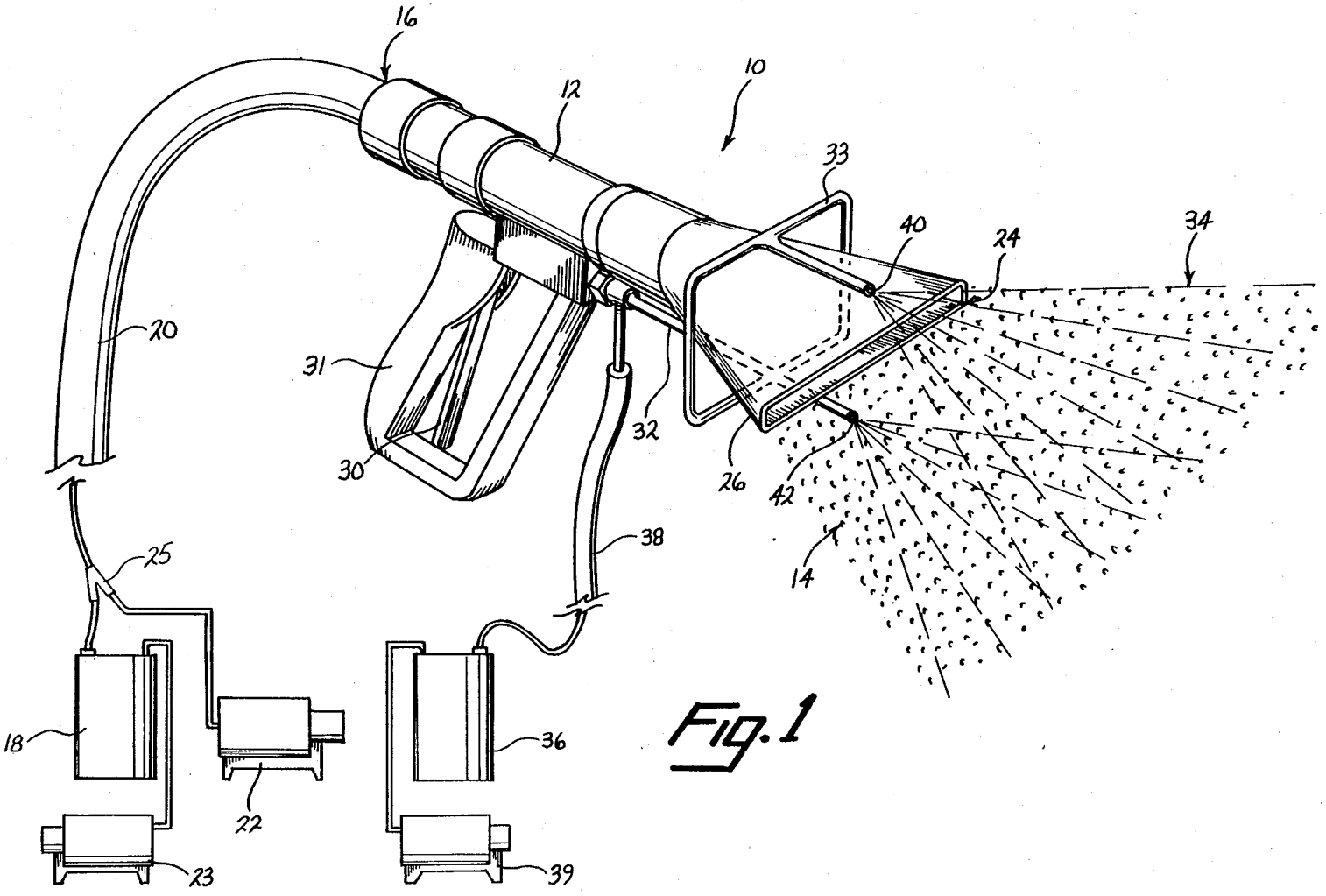
FIG. 1 is a perspective view of the apparatus of this invention, with certain components shown in diagrammatical form, illustrating the flow of the particles and adhesive schematically.
Figure 2:
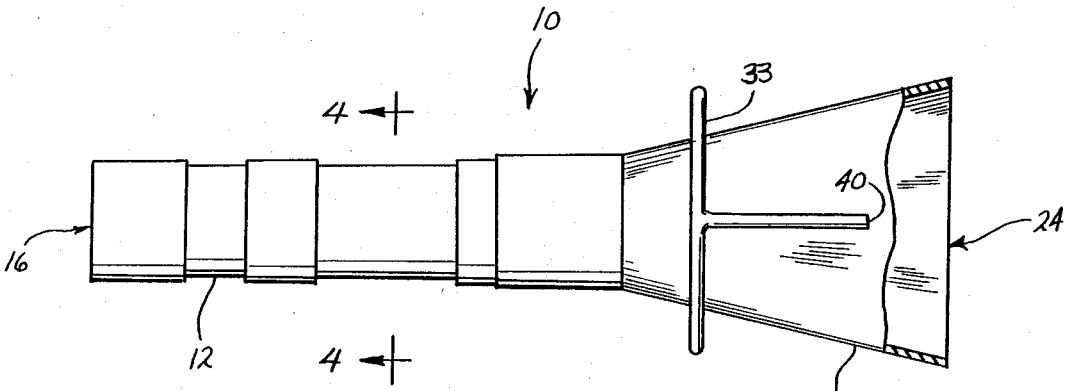
FIG. 2 is a top plan view of the apparatus, with parts broken away.

The preferred embodiment described herein is not intended to limit the invention to the precise form disclosed. It is chosen and described to explain the principles of the invention and their application and practical use, to thereby enable others skilled in the art to utilize the invention.

The method of this invention may be understood by following the description hereinafter set forth, and entails separate discharge of particles and adhesive in intersecting paths for midair contact thereof at a particle-coating zone before striking a target surface or substratum.

The expanded particles to be used are preferbly a commercially available type of expanded perlite, although other types of expanded particles may be used. A typical grade of perlite to be used is the type classified as Grade #1 produced by Silbrico Corporation, Chicago, Ill.

The adhesive material to be used may be either organic or inorganic in nature, depending upon the desired properties of the insulation product being produced. A typical organic adhesive may be the type described in my previous patent application, Ser. No. 295,242, filed Aug. 21, 1981, consisting essentially of a copolymer of ethylene/vinyl acetate wherein the ethylene concentration is 5–50% by weight. Use of this adhesive produces an inexpensive particle coating which dries quickly, has excellent tack, possesses a centipoise range between 800 and 3000, and is water soluble. Other organic adhesives and reins may be used, such as polyvinyl acetate, cellulose nitrate, phenolformaldehyde, epoxy, butadiene-styrene, polyvinyl butyral, polyesters, cyanoacrylates, polyester resins, latexes, polyethylenes, and ethylene-vinylacetate. I prefer to use the adhesives set forth in my previous patent applications, Ser. No. 295,242 and Ser. No. 322,173.

The method involved in this invention is unique in that even though the particles used are of a rock-like substance, a substantial degree of flexibility of the insulation coating is achieved. The method can be used to build an insulation coating up to 3" thickness during one application. The thermal conductivity of the material produced by this method possesses an R value of approximately 5 per inch, has a density of less than 20 pounds per cubic foot, is non-corrosive, and maintains a stucco effect.

Inorganic adhesives have been used in this method and have slightly different characteristics than those of organic adhesives. The use of inorganic adhesives occurs by the same method described herein. A preferable inorganic adhesive used in the method involves the use of magnesium oxide which is premixed with from 25%–75% of the aggregate to be sprayed. An aqueous polyphosphate solution of a primary base of aluminum, ammonia, calcium, iron, magnesium, potassium, and/or sodium is added to this mixture and produces an acid/-base type exothermic reaction with the magnesium oxide, yielding a salt compound. As this mixture is applied to the substratum, it cures in a very short time, hardens quickly, and possesses excellent fireproofing properties.

Another inorganic adhesive used may be that disclosed in my patent application Ser. No. 322,173 filed Nov. 17, 1981. This adhesive is a silicate derivative and is cured through an ionic type bonding. Silicate binders usually require autoclaving for durability and longevity. They cure upon themselves with time, but chemical autoclaving to assist curing and minimize flaking of the binder is preferred. An acid/adhesive mixture of any proportion can be used in a mixing chamber previous to discharge of the mixture from a spray nozzle. Any acid such as hydrochloric, nitric, phosphoric, citric, boric, sulphuric, or acetic in various concentrations or strengths from 5% to full concentration, can be used. Also, alcohols such as toluene, ammonia, carbon dioxide, triethylamine, diethylamine, ammonium persulfate, methyl or ethyl alcohol may be used to assist in curing or autoclaving the silicate prior to mixing thereof with the particles. Methyl or ethyl alcohol are preferred, as some flexibility of the insulation product is achieved in contrast to the dry hard flaky product surfaces produced when acids are used. The following table is a detailed analysis of the product which is produced by the method of this invention in which perlite was discharged at a pressure of approximately 3 psi at a rate of 45 cubic feet per minute at a distance of 18 inches from the substratum and an adhesive consisting of a copolymer of ethylene/vinyl acetate was discharged under pressure in a spray directed in paths inserting the paths of discharged perlite materials in a zone beginning approximately 6 inches from the discharge point.

TABLE I

| Organic Binder | | |
|---|---|---|
| Property | Test Method | Results |
| (I) Thermal Resistance (R) | ASTM C-177 | Approx. 5 |
| (II) Heat Resistance | ASTM E-84 | Will pass Class "A" |
| (III) Density | | 19 lbs./cu. ft. |
| (IV) Corrosiveness | HH-1-515-D | Passed on steel, aluminum and copper |
| (V) Moisture absorption conditions; 5.3% | | 1.2% moisture at ambient atmosphere at 100°/90% RH |
| (VI) Starch | | No starch in the system |
| (VII) Soak | 24 hour soak | No signs of delamination or failure |
| (VIII) Flatwise tension | | 8 psi. or 1150 lbs./sq. ft. |
| (IX) Freeze thaw | Actual conditions | Excellent |
| (X) Humidity swings | Humidity chamber | No effect |
| (XI) Service limits | | −40° F. to 350° F. |
| (XII) Flame spread | 2 foot tunnel | Estimated to be 10, no delamination or degradation |

Characteristics (I) Can be troweled to a smooth finish or used in a pebble texture appearance.

(II) Has possibilities as a roof application either as a substrata for thermal insulation or in its final form.

(III) Can be used within service limits over long periods of time without degradation.

(IV) Asbestos free.

(V) Resistant to flaking, dusting, delamination and spalling.

The characteristics of a product produced by the same method of the preceding example; except for use of an inorganic binder, were as follows:

TABLE II

| Inorganic Binder | | |
|---|---|---|
| Property | Test Method | Results |
| (I) Chemical resistance, 5 mil dry film on solvent wiped mild steel plates. | 14 days exposure at 120° F. to vapors in a sealed container. | No corrosion of plate, nor loss of film adhesion for 20% $H_2SO_4$ or $HNO_3$. |
| II Water resistance, 5 mil dry film on solvent wiped mild steel plate. | 30 days exposure to 100% humidity at 120° F. | No corrosion of plate, nor loss of adhesion, nor cracking, nor blistering. |

TABLE II-continued

| Property | Inorganic Binder Test Method | Results |
|---|---|---|
| III Salt spray resistance, 5 mil dry film on solvent wiped steel plate. | ASTM B-117 200 hrs. exposure | No corrosion of plate nor in scratch, no loss of adhesion, cracking, or blistering. |
| (IV) Corrosiveness, spray applied binder with perlite and mineral wool insulations. | (1) Fed. Spec. HH-1-515-D Sec. 3.1.7 | Passed with no corrosion of mild steel, soft copper or 3003 aluminum. |
| Corrosiveness, spray applied binder with perlite and mineral wool insulations. | (2) MIL-1-24244 stress corrosion | Pass, no cracking of stainless steel. |
| (V) Combustibility of sprayed-on perlite insulation. | ASTM E-136 | Non-combustible. |
| (VI) Flammability of sprayed-on perlite and mineral wool insulations. | ASTM E-162 | Flame spread index: less than 2.0 (no flaming). |
| (VII) Heat resistance, effect on compressive strength of binder/perlite. | ASTM C-165 | 75–95 psi. no fall off in strength with heat, where tested after 4 hrs. exposure to 75°, 200°, 400°, 600°, 800° and 1200° F. |
| (VIII) Thermal resistance, sprayed on mineral wool or perlite insulation system. | ASTM C-177 | K = .22–.25 R = 4.5–4.0 |
| (IX) Density of sprayed-on insulation, dried 14 days/75° F. minimum. | Weighing cut-out | 9–14 lbs./ft. |
| (X) Adhesion of insulation sprayed onto substrate, primed with binder, and sprayed with mineral wool and perlite. | 10 cycles of 8 hrs./400° F. +16 hrs./75° F. | No loss of adhesion applied onto mild steel, aluminum, cement, galvanized metal, cement-asbestos board or plywood. |
| (XI) Flexural strength of sprayed perlite system. | ASTM C-203 | 31 psi. |
| (XII) Tensile strength of sprayed perlite system. | 1.5 inch diameter steel cylinder bonded to surface and pulled off. | 10.6 psi. |
| (XIII) Acid test | Acids subjected to: $HNO_3$, HCl, $H_2SO_4$ | Passed, - no effect. |
| (XIV) Non-combustibility | ASTM E-136-73 | Passed. |
| (XV) Compression | Compression load to failure. | 49.8 psi. |
| (XVI) Shrinking incident to high humidity and to high temeprature. | Shrinking to −40° F. to 140° F. /100 RF for 48 hrs. | No cracking or delamination |
| (XVII) Noise reduction co-efficient. | ASTM C-423 | 0.35 |
| (XVIII) Co-efficient of thermal expansion of system. | ASTM 537 | Approx. 2.7 × 10 in./in. °F. |

Characteristics (I) Service limits: −40° to 1300° F.

(II) Retains integrity under service limits without degradation, delamination or flaking.

(III) Contains no asbestos.

(IV) No toxic gasses are given off at elevated temperatures.

In the preferred apparatus, the expanded perlite or vermiculite particles and the adhesive are contained in separate receptacles prior to their application to a target surface. Application is accomplished by discharging the particles and adhesive under pressure in directed intersecting paths toward the target surface, to contact at a particle coating zone prior to reaching the target surface. The preferred range of this zone is 12–16 inches from the target surface. The apparatus discharge produces a minimal bounce-back effect of the aggregate from the target surface, usually in the range of 4–10%. The method provided by the apparatus differs from premixing the particles and adhesive and then projecting the mixture toward a target surface under pressure which generally creates a high bounce-back ratio, and may cause loss of up to 50% of the applied coated aggregate, as well as increased density and lower the thermal resistance.

Several advantages of this method have been observed. First, a coating or product of high thermal resistance, or R value, is achieved due to the tendency for dead air, an excellent insulator, to become entrapped within the product. Second, a build-up of aggregate of desired thickness upon the target surface is achieved in a very short period of time. Third, the coated aggregate, when it has cured, is relatively hard and durable and creates a stucco-like appearance similar to concrete but still retains flexibility sufficient to accommodate thermal expansion and contraction of the substratum without loss of the bond of the product to the substratum. Fourth, the density of the product is less than that of available cementitious insulators and fireproofing materials. Finally, the spray discharged toward the target surface is not a hydride and contains no asbestos.

The method of forming the desired product requires a special spray apparatus. The apparatus involves a receptacle capable of holding the expanded particulates under a pressure in the range of ½ to 6 pounds per square inch, which can propel the particulates into an air stream controlled at a rate between 30 and 100 cubic feet per minute and in a range from ½ to 10 pounds per square inch. This characteristic causes the aggregate material to flow at a controlled rate for proper correlation to spray gun discharge of adhesive. No moving parts of the receptacle touch the aggregate during aggregate discharge.

The novel spray apparatus, generally designated as numeral 10, is shown in FIGS. 1–5. Apparatus 10 includes a hollow tubular member 12 which receives expanded particles 14 at inlet 16. Particles 14 are stored in a receptacle 18 and are discharged through a hose 20 under pressure supplied by a pump 23. The flow rate of particles 14 in the hose 20 is controlled by pressure supplied from air compressor 22 and connected to hose 20 at a venturi 25, which serves to draw particles into the hose. Particles 14 pass through hose 20 to inlet 16 and flow through member 12 at a preferred rate of 30–100 cubic feet per minute to discharge particles at outlet 24 at a pressure from ½ to 6 pounds per square inch. Outlet 24 is generally flared at its sides 26 and narrowed vertically to allow wide lateral dispersion of particles 14 as the particles are projected toward a target member or substratum 28. Controls through variable drives of pumps 22 and 23 regulate the flow of particles 14 through member 12.

Apparatus 10 also includes a rigid conduit 32 affixed thereto for flow of an ahesive therethrough. The adhesive is stored in a second receptacle 36 and is discharged through a conduit 38 under pressure which may be supplied by a pump 39. The adhesive travels through conduit 38 to and through a portion 33 of conduit 32 which encircles the outlet portion 24 of member 12. A plurality of spaced nozzle outlets 40, 42 branch from conduit portion 33 and are so positioned and constructed that an adhesive spray is discharged from each, as shown schematically by dotted lines 34 in FIGS. 1 and 5, in a pattern which is directed into and intersects the path of flow of particles 14 discharged from outlet 24. The adhesive is directed to contact the discharged particles 14 spaced from apparatus 10 prior to striking target surface 28 when the apparatus is held in spaced relation to target surface 28. In this manner, particles 14 are coated with adhesive 34 before striking the target surface 28 and adhere to surface 28 with minimal loss due to bounce-back upon impact of the adhesive-coated aggregate 44 with the target surface. A control means operated by trigger 30 associated with a hand grip 31 serves to actuate the flow of adhesive 34. Pump 39 serves to regulate the flow rate of adhesive 34, so that the correct concentration ratio of particles 14 to the adhesive may be selected to insure coating of the particles and provide maximum bonding of coated aggregate 44 to target surface 28.

Figure 4:
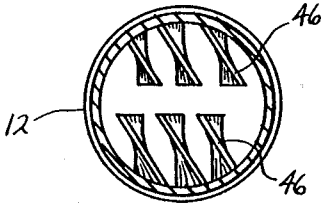
FIG. 4 is a cross-sectional view taken along line 4—4 of FIG. 2.
Figure 4A:
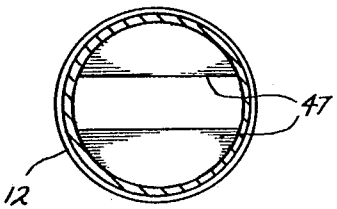
FIG. 4A is a cross-sectional view taken along line 4—4 of FIG. 2, showing an alternative construction.
Figure 3:
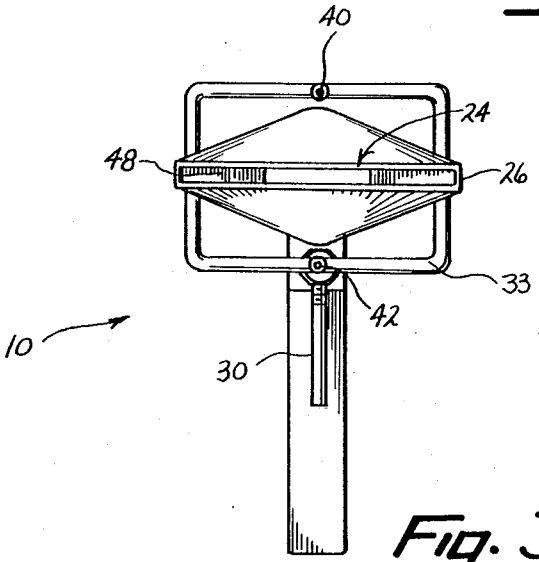
FIG. 3 is an end view of the apparatus of FIG. 1.
Figure 5:
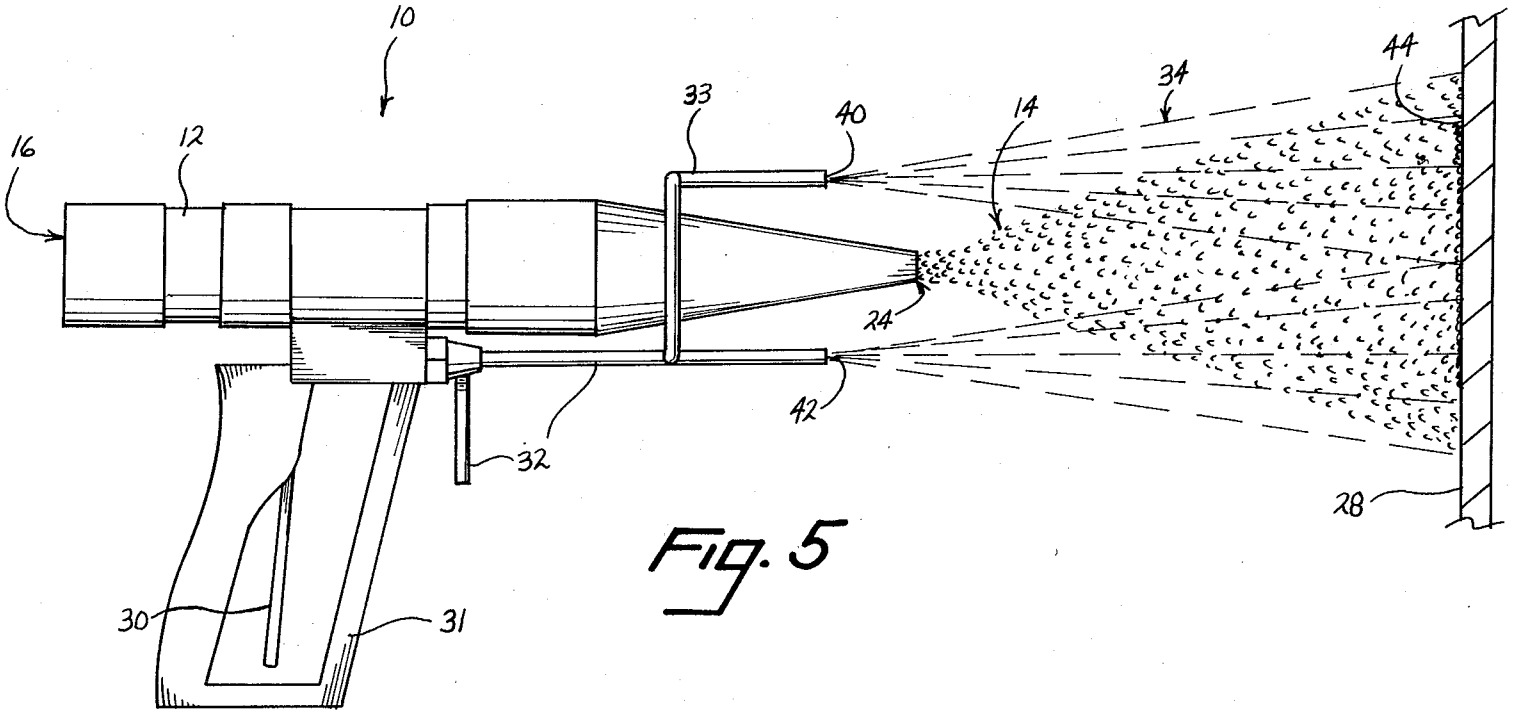
FIG. 5 is a side view of the apparatus illustrating the flow of the particles and adhesive in schematic form as they approach and strike a target surface.

Mounted within member 12 are a plurality of transversely positioned baffle plates 46. Baffle plates 46 serve to direct particles 14 through tube 12 into the desired fan discharge pattern correlating to the pattern of adhesive spray flow 34, to insure pre-target surface contact and coating of the particles by the adhesive. An alternative construction of the baffle plates 47 is shown in FIG. 4A.

It is to be understood that the above description does not limit the invention which may be modified within the scope of the appended claims.

I claim:

1. The method of applying a lightweight particulate insulation material to a target surface to a thickness of up to three inches in successive applications consisting of the steps of:

providing in one container a quantity of lightweight expanded particles consisting of a material selected from the group consisting of perlite and vermiculite, and providing in a second container a quantity of an adhesive material;

providing first conduit means for discharging said particles from said one container, said first conduit means including a narrow, outwardly flared outlet for discharging said particles into a substantially horizontal planar fan pattern;

providing second conduit means for discharging a spray of said adhesive from said second container;

and simultaneously discharging said particles at a pressure in the range of $\frac{1}{2}$ to 6 pounds per square inch and discharging a spray of said adhesive in directed intersecting paths toward said target surfaces whereby the adhesive spray contacts said particles in air prior to reaching said target surface, and continuing said discharge across said target surface in successive passes until fire proof insulation coating of selected thickness is achieved;

said adhesive consisting essentially of a silicate derivative compound;

and a step of autoclaving said silicate derivative adhesive with an acid prior to discharging said adhesive towards said target surface.

* * * * *